US009550951B2

(12) United States Patent
Fusselman

(10) Patent No.: US 9,550,951 B2
(45) Date of Patent: Jan. 24, 2017

(54) WATER CONSERVING SYNGAS CLEANUP SYSTEM

(71) Applicant: Gas Technology Institute, Des Plaines, IL (US)

(72) Inventor: Steven P. Fusselman, Sacramento, CA (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 14/429,853

(22) PCT Filed: Jan. 24, 2013

(86) PCT No.: PCT/US2013/022976
§ 371 (c)(1),
(2) Date: Mar. 20, 2015

(87) PCT Pub. No.: WO2014/046714
PCT Pub. Date: Mar. 27, 2014

(65) Prior Publication Data

US 2015/0247099 A1 Sep. 3, 2015

Related U.S. Application Data

(60) Provisional application No. 61/705,083, filed on Sep. 24, 2012.

(51) Int. Cl.

| | |
|---|---|
| ***C10J 3/84*** | (2006.01) |
| ***C10J 3/48*** | (2006.01) |
| ***C10K 1/00*** | (2006.01) |
| ***C10K 1/02*** | (2006.01) |

(Continued)

(52) U.S. Cl.
CPC ..... *C10J 3/845* (2013.01); *C10J 3/485* (2013.01); *C10J 3/52* (2013.01); *C10K 1/003* (2013.01); *C10K 1/007* (2013.01); *C10K 1/02* (2013.01); *C10K 1/024* (2013.01); *C10K 1/122* (2013.01); *C10J 2200/09* (2013.01); *C10J 2300/0959* (2013.01); *C10J 2300/0976* (2013.01);

(Continued)

(58) Field of Classification Search
CPC ..... C10J 2300/1625; C10J 2300/0959; C10J 2300/0976; C10J 3/52; C10J 3/845; C10J 2300/169; C10J 3/485; C10J 2300/1807; C10J 2200/09; C10K 1/024; C10K 1/003; C10K 1/122; C10K 1/007; C10K 1/02
See application file for complete search history.

(56) References Cited

U.S. PATENT DOCUMENTS

| | | | |
|---|---|---|---|
| 4,145,274 A | 3/1979 | Green et al. | |
| 4,525,280 A | 6/1985 | Vasconcellos et al. | |
| 4,854,942 A | 8/1989 | Denney et al. | |

(Continued)

FOREIGN PATENT DOCUMENTS

| | | | |
|---|---|---|---|
| WO | 01/85609 | 11/2001 | |
| WO | WO 0185609 A1 * | 11/2001 | ..... B01D 47/10 |

OTHER PUBLICATIONS

International Search Report for PCT Application No. PCT/US2013/022976 completed Mar. 5, 2013.

*Primary Examiner* — Stanley Silverman
*Assistant Examiner* — Syed Iqbal
(74) *Attorney, Agent, or Firm* — Pauley Erickson & Kottis

(57) ABSTRACT

A gasification system includes a scrubber in communication with a particulate removal subsystem and a quench subsystem.

7 Claims, 2 Drawing Sheets

(51) Int. Cl.
*C10K 1/12* (2006.01)
*C10J 3/52* (2006.01)

(52) U.S. Cl.
CPC .. *C10J 2300/169* (2013.01); *C10J 2300/1625* (2013.01); *C10J 2300/1807* (2013.01)

(56) References Cited

U.S. PATENT DOCUMENTS

| | | | | |
|---|---|---|---|---|
| 6,607,671 | B2 | 8/2003 | Vuong | |
| 2003/0034297 | A1* | 2/2003 | Vuong | B01D 21/08 210/533 |

* cited by examiner

WATER CONSERVING SYNGAS CLEANUP SYSTEM

BACKGROUND

The present disclosure relates generally to gasifiers for converting a carbonaceous feedstock, such as coal, biomass or petcoke, into a synthesis gas.

The gasification of coal and petcoke to synthesis gas (syngas), e.g. a gas mixture primarily comprised of hydrogen and carbon monoxide, is an effective industrial process used in the chemical and power industries. Gasification units produce a very fine slag and water soluble species (hydrochloric acid, among others) that must be scrubbed from the product syngas stream prior to use downstream. The processes to scrub the syngas may be relatively complex, energy intensive and expensive. Furthermore, the process generates relatively large quantities of wastewater with existing gasification technologies, as these do not offer a convenient, cost-effective way to separate the ash and water soluble species from the scrubber water.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
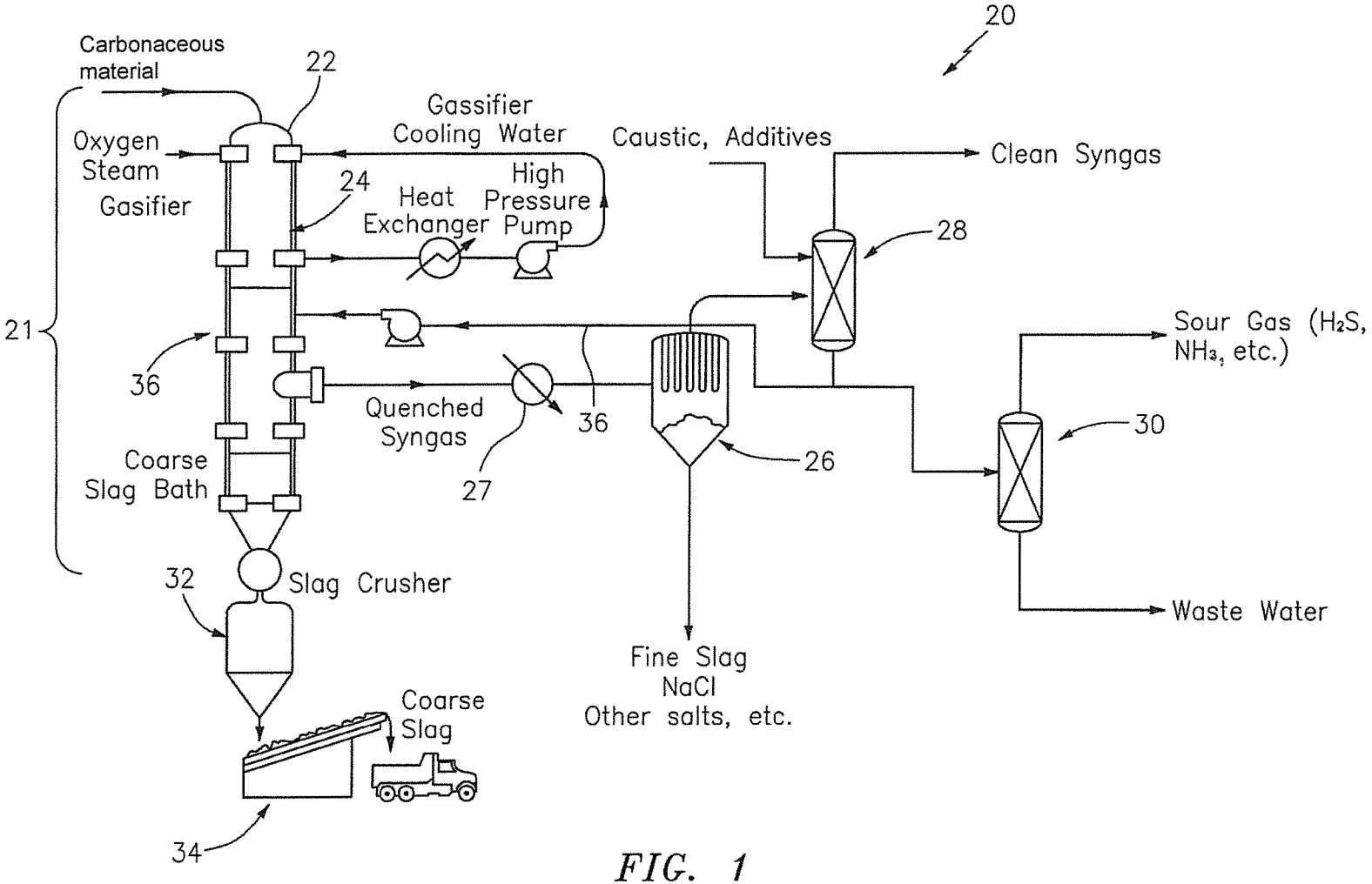
FIG. 1 is a schematic block diagram of a gasification system.

FIG. 1 schematically illustrates a compact, highly efficient gasification system 20 operable to produce a syngas from a carbonaceous material such as coal, biomass or petcoke, in accordance with one disclosed non-limiting embodiment. The gasification system 20 generally includes a gasifier 21 that includes an injector module 22 coupled to a gasifier chamber 24. The injector module 22 is adapted to inject a carbonaceous fuel stream at high pressure into the gasifier chamber 24 and impinge a high-pressure oxidation reactant onto the fuel stream to generate a gasification reaction within the gasifier chamber 24 that converts the carbonaceous fuel into a synthesis gas. More specifically, the injector module 22 mixes a carbonaceous material, such as coal, biomass or petcoke, with a transporting gas, such as nitrogen $N_2$, carbon dioxide $CO_2$ or a synthesis gas, for example, a mixture of hydrogen and CO, to form the fuel feed stream. The injector module 22 then injects the fuel feed stream, at a pressure, into the gasifier chamber 24 and substantially simultaneously, injects other reactants, such as oxygen and steam, into the gasifier chamber 24. Particularly, the injector module 22 may impinge other reactants on the fuel feed stream to cause a gasification reaction that produces high-energy content synthesis gas (syngas), for example, hydrogen and carbon monoxide.

The syngas is communicated to a particulate removal subsystem 26 such as a candle filter or cyclone. From the particulate removal subsystem 26, the syngas may optionally be cooled in a heat exchanger 27 to raise steam and/or reheat process streams such as clean syngas. The heat exchanger 27 can be placed either upstream or downstream of the particulate removal system.

The syngas from the particulate removal subsystem 26 is communicated to a scrubber 28 where contact with water removes slag particles and syngas-borne water soluble species such as Chlorine (Cl), Selenium (Se), etc. Sodium hydroxide (NaOH) is added to neutralize Cl that is typically present as Hydrochloric acid (HCl) in the syngas to generate Sodium chloride (NaCl) in the scrubber water. An upper limit for Cl permitted in the scrubber water is typically the parameter that sizes the discharge rate for wastewater from a stripper 30 that removes sour gas from the wastewater prior to disposal.

A quench subsystem 36 in the gasification system 20 receives recycled scrubber water from the scrubber 28 through a scrubber water recycle system 38 to cool the syngas down to approximately 700° F. (371° C.) and provide a dry, unsaturated syngas for fine particulate removal. The partial quench provided by the quench subsystem 36 generates a dry gas product at temperatures well below the melting point of slag and the sticking point of most salts. Any non-evaporated quench water will drop into a slag lockhopper 32, along with coarse slag. Water from a slag dewatering conveyor 34 may be communicated to the scrubber 28 such that no water is lost.

A small fraction of the scrubber water from the scrubber 28 may be discharged to the stripper 30, where wastewater is discharged appropriately after sour gases ($H_2S$, $NH_3$) are stripped. This wastewater stream in one disclosed non-limiting embodiment is approximately 1% of that required for other technologies that do not remove Cl in the particulate removal subsystem 26.

Figure 2:
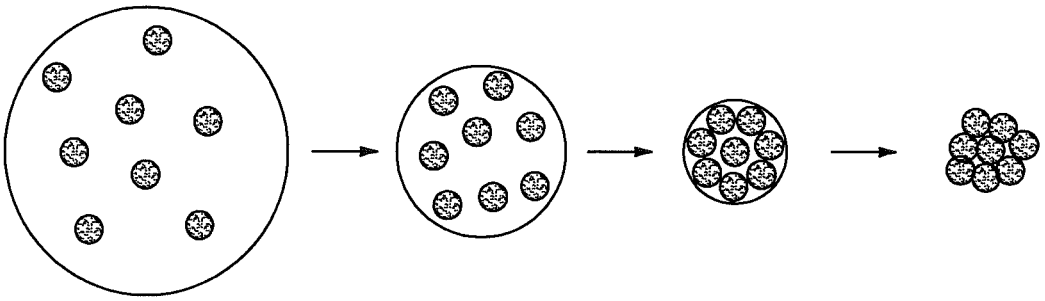
FIG. 2 is a schematic view of a quench spray droplet containing fine slag particles and dissolved salts (i.e., NaCl) that coalesce as droplet shrinks during evaporation in quench chamber such that after water completely evaporates an agglomeration of fine particles, with dissolved salts are collected in an agglomeration.

Most of the scrubber water discharged from the scrubber 28, however, is recycled to the quench subsystem 36 and there is always some fraction of fine slag particles that pass through the particulate removal subsystem 26, e.g., a fraction of a percent in the candle filter arrangement, and a few percent for a cyclone. The quench spray droplets thereby contain fine slag particles and dissolved salts (i.e., NaCl) that begin to coalesce as the quench droplets shrink during evaporation in the quench subsystem 36 of the gasification system 20 (FIG. 2). The fine slag particles are typically less than 5 microns in diameter while the quench droplets are typically greater than 50 microns in diameter such that 10's to 100's of the fine slag particles are contained in each quench droplet and are consolidated into agglomerates (FIG. 2).

The fine slag particles that pass through the particulate removal subsystem 26 are thereby recycled to the quench subsystem 36 of the gasification system 20 with the scrubber water recycle stream 38. This facilitates the introduction of chemicals to convert the water-soluble species from volatile species to non-volatile water soluble salts—such as reacting HCl with NaOH to form the NaCl. The quench water is vaporized in the quench subsystem 36 which leaves agglomerated particles, with any dissolved water soluble species such as salts collected on particle surfaces and in the voids, that is relatively large compared to the fine slag particles. In some cases, van der Waals forces between these particles may be sufficient to cause them to agglomerate. In other cases, the water soluble salts, which will accumulate between these particles as the water vaporizes away, may serve as a "glue" to promote agglomeration. In another disclosed non-limiting embodiment, additional components promoting fine particle agglomeration, such as water soluble salts, may be injected to still further promote this agglomeration effect.

The agglomeration effect greatly increases the efficiency of the particulate removal subsystem 26. Salts (NaCl, etc.) are non-volatile, and remain behind on the agglomerate after the quench water evaporates. The fine slag particles and water soluble species are thereby essentially completely captured as dry solid agglomerates which may permit elimination of typical black water systems by greatly reducing wastewater discharge.

An advantageous aspect of the agglomeration effect is that it does not have to be highly efficient in achieving removal on a "per pass" basis, just efficient enough to work down the accumulation of these materials in the scrubber water system to keep up with the incoming water soluble species/very fine particles.

The quench subsystem 36 reduces the amount of wastewater discharged from the gasifier system 20 by 90% or more and reduces the capital cost of syngas scrubber and sour water stripper equipment. The quench subsystem 36 also allows use of less expensive fine particulate removal systems, such as cyclones in place of candle filters, without increased discharge of wastewater.

It should be understood that relative positional terms such as "forward," "aft," "upper," "lower," "above," "below," and the like are with reference to the normal operational attitude of the system and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims It is therefore to be understood that within the scope of the appended claims, the disclosure may be practiced other than as specifically described. For that reason the appended claims should be studied to determine true scope and content.

What is claimed is:

1. A gasification system comprising:

an entrained flow gasifier generating a high temperature synthesis gas product including at least one of fine particulate solids and volatile, water soluble species;

a quench subsystem to cool the synthesis gas exiting the entrained flow gasifier to a temperature above a dew point by evaporation cooling of an injected liquid;

a dry particulate removal subsystem to remove a portion of the fine particulate solids from the synthesis gas as dry solids; and a scrubber to remove a portion of the fine particulate solids and the volatile, water soluble species from the synthesis gas exiting the dry particulate removal system and in communication with said quench subsystem, wherein said scrubber recycles a fraction of a scrubber water including a remaining portion of the fine particulate solids to said quench subsystem; and a quench spray system for dispersing the recycled scrubber water as liquid droplets including the remaining portion of the fine particulate solids into the quench subsystem, wherein the droplets evaporate to promote agglomeration of at least one of fine particulate solids and volatile, water soluble species into larger particulates to be removed in the dry particulate removal system.

2. The gasification system as recited in claim 1, wherein said dry particulate removal subsystem is a candle filter.

3. The gasification system as recited in claim 1, wherein said dry particulate removal subsystem is a cyclone.

4. The gasification system as recited in claim 1, wherein said particulate removal subsystem is downstream of said quench subsystem to receive syngas.

5. The gasification system as recited in claim 1, further comprising a heat exchanger in communication with said particulate removal system.

6. The gasification system as recited in claim 1, wherein chemical agents are added to the scrubber water to convert the volatile, water soluble species in the synthesis gas into at least one of non-volatile, water soluble species and species insoluble in water to enable capture of these species with fine particulates in the dry particulate removal subsystem upon recycle and evaporation of the scrubber water within the quench subsystem.

7. The gasification system as recited in claim 1, wherein chemical agents are added to the scrubber water to promote agglomeration of fine particulates suspended in the recycled scrubber water upon recycle and evaporation of scrubber water within the quench subsystem, enabling subsequent removal in the dry particulate removal subsystem.

* * * * *